US008865383B2

(12) United States Patent
Suzuki et al.

(10) Patent No.: US 8,865,383 B2
(45) Date of Patent: Oct. 21, 2014

(54) TONER, TONER SET, DEVELOPER, DEVELOPER SET, IMAGE FORMING APPARATUS, IMAGE FORMING METHOD, AND PROCESS CARTRIDGE

(75) Inventors: Kazumi Suzuki, Shizuoka (JP); Tatsuya Morita, Kanagawa (JP); Shingo Sakashita, Shizuoka (JP); Tsuyoshi Sugimoto, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 102 days.

(21) Appl. No.: 13/236,839

(22) Filed: Sep. 20, 2011

(65) Prior Publication Data

US 2012/0082926 A1 Apr. 5, 2012

(30) Foreign Application Priority Data

Sep. 30, 2010 (JP) ..... 2010-221241

(51) Int. Cl.

| | |
|---|---|
| ***G03G 9/13*** | (2006.01) |
| ***G03G 9/087*** | (2006.01) |
| ***G03G 9/08*** | (2006.01) |
| ***G03G 9/09*** | (2006.01) |

(52) U.S. Cl.

CPC ..... *G03G 9/08755* (2013.01); *G03G 9/0804* (2013.01); *G03G 9/08795* (2013.01); *G03G 9/08797* (2013.01); *G03G 9/09* (2013.01); *G03G 9/091* (2013.01); *G03G 9/0918* (2013.01); *G03G 9/092* (2013.01); *G03G 9/0924* (2013.01)

USPC ..... 430/107.1; 430/105; 430/106; 430/110.2

(58) Field of Classification Search

USPC ..... 430/107.1, 105, 106, 110.2

See application file for complete search history.

(56) References Cited

U.S. PATENT DOCUMENTS

| | | | | |
|---|---|---|---|---|
| 5,318,871 | A * | 6/1994 | Inagaki et al. | 430/110.1 |
| 5,920,756 | A * | 7/1999 | Matsuda et al. | 399/307 |
| 6,821,698 | B2 * | 11/2004 | Sawada et al. | 430/108.4 |
| 2008/0187854 | A1 * | 8/2008 | Yoshida et al. | 430/109.4 |
| 2010/0151377 | A1 * | 6/2010 | Uchino et al. | 430/110.2 |
| 2011/0008723 | A1 | 1/2011 | Morita et al. | |
| 2011/0177447 | A1 | 7/2011 | Suzuki et al. | |

FOREIGN PATENT DOCUMENTS

| | | |
|---|---|---|
| JP | 4-70765 | 3/1992 |
| JP | 2004-245854 | 9/2004 |
| JP | 2006-18018 | 1/2006 |
| JP | 2006-145703 | 6/2006 |
| JP | 2006-208609 | 8/2006 |

(Continued)

OTHER PUBLICATIONS

Office Action issued Apr. 1, 2014 in Japanese Patent Application No. 2010221241 filed Sep. 30, 2010.

*Primary Examiner* — Mark F Huff
*Assistant Examiner* — Olatunji Godo
(74) *Attorney, Agent, or Firm* — Oblon, Spivak, McClelland, Maier & Neustadt, L.L.P.

(57) ABSTRACT

A toner comprising an amorphous polyester, a crystalline polyester that is forming domains in the toner, and a colorant that is being dispersed at least in the domains of the crystalline polyester. The toner may be obtained by dispersing an oil phase including the amorphous polyester or a precursor capable of producing the amorphous polyester, the crystalline polyester, the colorant, and an organic solvent, in an aqueous medium to prepare an O/W dispersion, the oil phase; and removing the organic solvent from the O/W dispersion.

7 Claims, 4 Drawing Sheets

(56) References Cited

FOREIGN PATENT DOCUMENTS

| | | |
|---|---|---|
| JP | 2006-209094 | 8/2006 |
| JP | 2006-337872 | 12/2006 |
| JP | 2007-34280 | 2/2007 |
| JP | 2008-112165 | 5/2008 |
| JP | 2008-281884 | 11/2008 |
| JP | 2009-53504 | 3/2009 |
| JP | 2009-109971 | 5/2009 |
| JP | 2010-91838 | 4/2010 |

* cited by examiner

TONER, TONER SET, DEVELOPER, DEVELOPER SET, IMAGE FORMING APPARATUS, IMAGE FORMING METHOD, AND PROCESS CARTRIDGE

CROSS-REFERENCE TO RELATED APPLICATIONS

This patent application is based on and claims priority pursuant to 35 U.S.C. §119 to Japanese Patent Application No. 2010-221241, filed on Sep. 30, 2010, in the Japan Patent Office, the entire disclosure of which is hereby incorporated herein by reference.

FIELD OF THE INVENTION

The present invention relates to a toner for developing electrostatic latent images in electrophotography, electrostatic recording, and electrostatic printing. The present invention also relates to a toner set, a developer, a developer set, an image forming apparatus, an image forming method, and a process cartridge using the toner.

BACKGROUND OF THE INVENTION

In electrophotography, electrostatic recording, and electrostatic printing, an image is formed by a series of processes including forming an electrostatic latent image on an electrostatic latent image bearing member (hereinafter "photoreceptor"), developing the electrostatic latent image into a toner image by a developer, transferring the toner image onto a recording medium such as paper, and fixing the toner image on the recording medium. Developers for developing electrostatic latent images into toner images are of two types: one-component developers consisting of a magnetic or non-magnetic toner and two-component developer consisting of a toner and a carrier.

Owing to its high energy efficiency, a fixing method in which a heat roller directly presses a toner image against a recording medium is widely used. (This method is hereinafter referred to as heat roller method.) Because a great amount of electric power is consumed in the heat roller method, there have been various attempts to reduce electric power consumption. For example, one approach involves reducing output of a heater that heats the heat roller while image formation is not occurring and increasing output of the heater while image formation is occurring. This approach has been widely employed. However, it requires several ten seconds until the heat roller is recovered from the sleep mode and heated to a proper temperature to be ready for fixing, which may be stressful for users. More preferably, the heater should be completely off while image formation is not occurring to more reduce electric power consumption. On the other hand, toners are required to be fixable at much lower temperatures to more reduce electric power consumption.

Because toners are required to have low-temperature fixability and storage stability (i.e., blocking resistance) in accordance with recent developments in electrophotographic technologies, polyester resins are more widely employed as binder resin than conventionally-used styrene resins recently. Polyester resins generally have high affinity for recording media, and therefore they can be fixed on recording media at low temperatures (hereinafter "low-temperature fixability"). For example, Japanese Patent Application Publication No. 2004-245854 describes a toner including a linear polyester resin having specific properties, and Japanese Patent Application Publication No. 04-70765 describes a toner including a nonlinear cross-linked polyester resin obtained from an acid and rosin.

However, these toners still do not meet the requirements of energy saving because they cannot keep sufficient fixing strength on recording media when the fixing time period is short or the fixing temperature is low.

Japanese Patent Application Publication No. 2006-208609 describes a toner including a fixing auxiliary component (plasticizer) which is soluble in resins when heated. In this toner, the fixing auxiliary agent exists in the toner forming its crystalline domains thereof. It is described therein that the toner is given both heat-resistant storage stability and low-temperature fixability. Japanese Patent Application Publication Nos. 2009-109971 and 2006-337872 each describe a toner including a crystalline polyester. It is also described therein that these toners are also given both heat-resistant storage stability and low-temperature fixability.

However, it is likely that such fixing auxiliary components are dissolved in binder resins in the process of manufacturing toner, which may result in poor heat-resistant storage stability of the toner. Recent toners are also required to have high coloring power in view of energy conservation. Thus, recent toners have a high colorant content. However, when a toner containing a fixing auxiliary component (e.g., a plasticizer, a crystalline polyester) has a high colorant content, undesirably, the resulting image has low and nonuniform gloss and poor color reproducibility.

The reason for the low and nonuniform gloss is considered that the colorant dispersed in an amorphous binder resin excessively increases elasticity of the amorphous binder resin. The reason for the poor color reproducibility is considered that the fixing auxiliary component is not compatible with the amorphous binder resin even when heated, and therefore the colorant cannot be uniformly extended over the resulting image.

BRIEF SUMMARY OF THE INVENTION

Exemplary aspects of the present invention are put forward in view of the above-described circumstances, and provide a novel toner having a good combination of low-temperature fixability, offset resistance, uniform gloss, and color reproducibility.

In one exemplary embodiment, a novel toner comprises an amorphous polyester, a crystalline polyester that is forming domains in the toner, and a colorant that is being dispersed at least in the domains of the crystalline polyester. The toner may be obtained by dispersing an oil phase including the amorphous polyester or a precursor capable of producing the amorphous polyester, the crystalline polyester, the colorant, and an organic solvent, in an aqueous medium to prepare an O/W dispersion, the oil phase; and removing the organic solvent from the O/W dispersion.

DETAILED DESCRIPTION OF THE INVENTION

Figure 1:
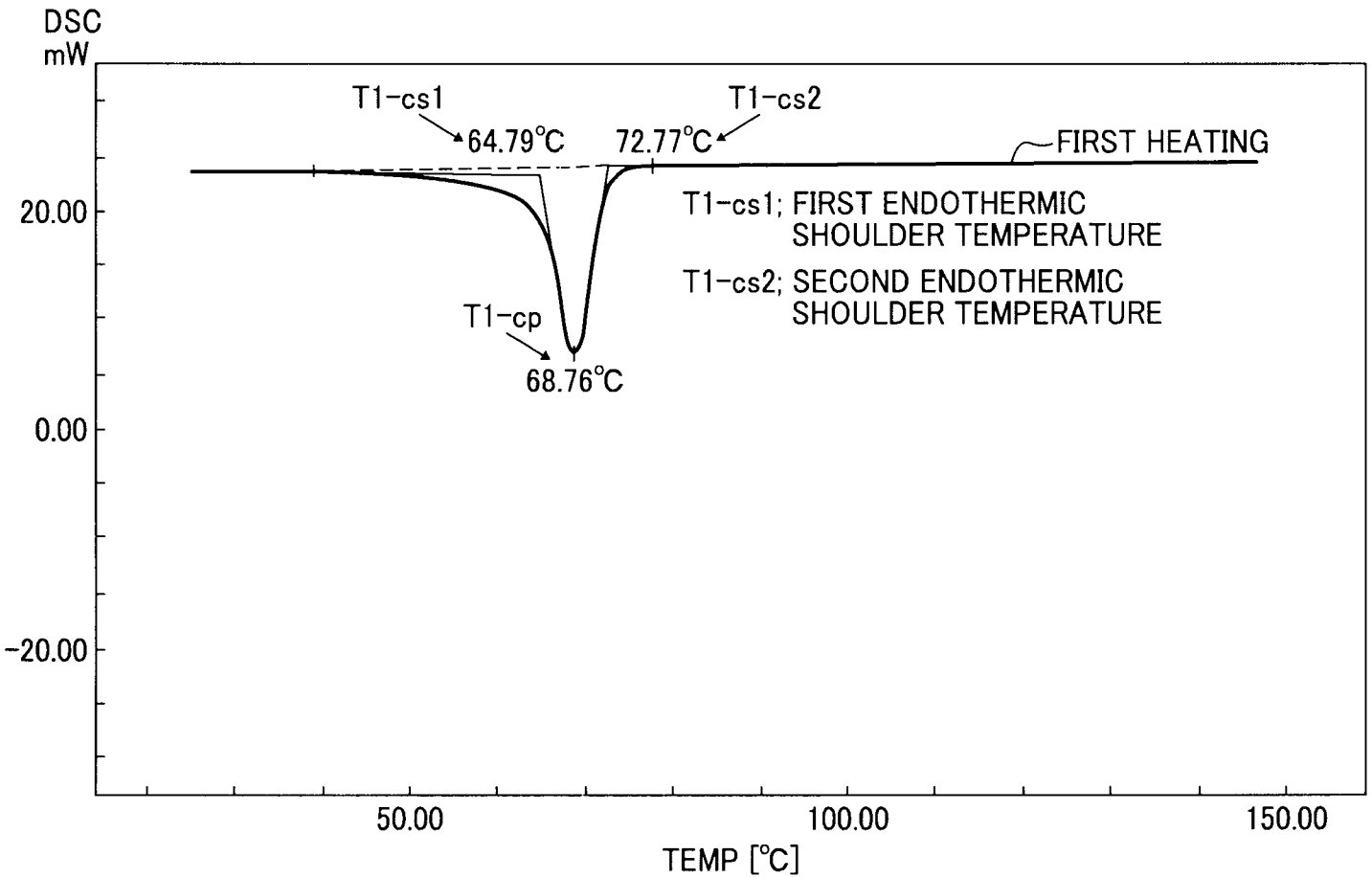
FIG. 1 shows an exemplary differential scanning calorimetric chart of a crystalline polyester.

Exemplary aspects of the present invention provides a toner comprising an amorphous polyester, a crystalline polyester that is forming domains in the toner, and a colorant that is being dispersed in at least the domains of the crystalline polyester. The toner may be obtained by dispersing an oil phase including the amorphous polyester or a precursor capable of producing the amorphous polyester, the crystalline polyester, the colorant, and an organic solvent, in an aqueous medium to prepare an O/W dispersion; and removing the organic solvent from the O/W dispersion.

Unlike a toner in which the colorant is dispersed in an amorphous resin, the elasticity of which is excessively increased when heated, the colorant is dispersed in the crystalline polyester, the viscosity of which is reduced when heated. Thus, the colorant can be extended over the resulting image and the toner provides high gloss and high color reproducibility.

Specific preferred materials for use in the toner are described in detail below.

Specific examples of suitable alcohol monomers for preparing the amorphous polyester include, but are not limited to, divalent alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and cyclic ether (e.g., ethylene oxide, propylene oxide) adduct bisphenol A.

To form a cross-linking structure in the amorphous polyester, tri- or more valent alcohols are preferably used in combination. Specific examples of such tri- or more valent alcohols include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Specific examples of suitable acid monomers for preparing the amorphous polyester include, but are not limited to, benzene dicarboxylic acids (e.g., phthalic acid, isophthalic acid, terephthalic acid) and anhydrides thereof, alkyl dicarboxylic acids (e.g., succinic acid, adipic acid, sebacic acid, azelaic acid) and anhydrides thereof, unsaturated dibasic acids (e.g., maleic acid, citraconic acid, itaconic acid, alkenylsuccinic acid, fumaric acid, mesaconic acid), and unsaturated dibasic acid anhydrides (e.g., maleic acid anhydride, citraconic acid anhydride, itaconic acid anhydride, alkenylsuccinic acid anhydride). Additionally, tri- or more valent carboxylic acids such as trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, enpol trimmer acid, and anhydrides and partial lower alkyl esters of these compounds, are also usable.

THF-soluble components in the amorphous polyester preferably have a weight average molecular weight (Mw) of $8.0\times10^3$ to $5.0\times10^4$ determined from a molecular weight distribution measured by GPC (gel permeation chromatography). When Mw is less than $8.0\times10^3$, the resulting toner may include residual solvents in a very small amount but may have poor offset resistance and storage stability. When Mw is more than $5.0\times10^4$, it may be difficult to reduce residual solvent concentration to 200 ppm or less.

The amorphous polyester preferably has an acid value of 0.1 to 100 mgKOH/g, more preferably 5 to 70 mgKOH/g, and most preferably 10 to 50 mgKOH/g.

The acid value can be measured based on a method according to JIS K0070-1992 as follows. First, 0.5 g of a sample (i.e., 0.3 g of ethyl acetate-soluble components in the sample) are dissolved in 120 ml of toluene by agitation for about 10 hours at 23° C. Next, 30 ml of ethanol are further added to prepare a sample solution. In a case in which the samples is insoluble in toluene, toluene can be replaced with another solvent such as dioxane and tetrahydrofuran. The sample solution is subjected to a measurement with an automatic potentiometric titrator DL-53 and electrodes DG113-SC (both from Mettler-Toledo International Inc.) at 23° C. to determine the acid value using an analysis software program LabX Light Version 1.00.000. The measurement instrument is calibrated with a mixed solvent of 120 ml of toluene and 30 ml of ethanol. The sample solution is titrated with a 0.1N potassium hydroxide alcohol solution, and the acid value is calculated from the following formula:

$$\text{Acid value (KOH mg/g)} = \text{Titer (ml)} \times N \times 56.1\ \text{(mg/ml)} / \text{Sample weight (g)}$$

wherein N represents a factor of the 0.1N potassium hydroxide alcohol solution.

The toner may further include a vinyl polymer other than the amorphous polyester. At least one of the vinyl polymer and the amorphous polyester may be formed from a monomer reactive with the other. For example, the amorphous polyester may be formed from a monomer reactive with the vinyl polymer, such as an unsaturated dicarboxylic acid (e.g., phthalic acid, maleic acid, citraconic acid, itaconic acid) and anhydride thereof. For example, the vinyl polymer may be formed from a monomer such as a carboxyl-group-containing monomer, a hydroxyl-group-containing monomer, an acrylate, and a methacrylate.

The toner as well as the total binder resin in the toner preferably has a glass transition temperature (Tg) of 35 to 80° C., and more preferably 40 to 75° C. When Tg is too low, the toner may easily deteriorate in high-temperature atmosphere and may cause offset when fixed on a recording medium. When Tg is too high, the toner may have poor fixability.

The precursor capable of producing the amorphous polyester may be, for example, a polyester prepolymer modified with an isocyanate or epoxy. Such a polyester prepolymer is capable of elongating with a compound having an active hydrogen group (e.g., amine). The resulting polyester improves the fixable temperature range (i.e., the difference between the minimum and maximum fixable temperatures). The polyester prepolymer can be obtained by reacting a base polymer with an isocyanating agent or an epoxidation agent.

Specific examples of the isocyanating agent include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., $\alpha,\alpha,\alpha',\alpha'$-tetramethylxylylene diisocyanate), isocyanurates, and the above polyisocyanates in which the isocyanate group is blocked with a phenol derivative, an oxime, or a caprolactam. Two or more of these compounds can be used in combination.

Specific examples of the epoxidation agent include, but are not limited to, epichlorohydrin.

The equivalent ratio [NCO]/[OH] of isocyanate groups [NCO] in the isocyanating agent to hydroxyl groups [OH] in the base polyester is preferably 5/1 to 1/1, more preferably 4/1 to 1.2/1, and most preferably from 2.5/1 to 1.5/1. When the equivalent ratio [NCO]/[OH] is too large, low-temperature fixability of the resulting toner may be poor. When the equivalent ratio [NCO]/[OH] is too small, hot offset resistance of the resulting toner may be poor because the content of urea in the polyester prepolymer is too small.

The polyester prepolymer preferably includes the isocyanating agent units in an amount of 0.5 to 40% by weight, more preferably 1 to 30% by weight, and most preferably 2 to 20% by weight. When the ratio of the isocyanating agent units is too small, hot offset resistance, heat-resistant storage stability, and low-temperature fixability of the resulting toner may be poor. When the ratio of the isocyanating agent units is too large, low-temperature fixability of the resulting toner may be poor.

The average number of isocyanate groups included in one molecule of the polyester prepolymer is preferably 1 or more, more preferably 1.5 to 3, and most preferably 1.8 to 2.5. When the average number of isocyanate groups is too large or small, hot offset resistance of the resulting toner may be poor because the molecular weight of the resulting urea-modified polyester is too small.

The precursor preferably has a weight average molecular weight of $1\times10^4$ to $3\times10^5$.

The compound having an active hydrogen group may be, for example, an amine. As described above, the compound having an active hydrogen group is capable of elongating or cross-linking with the precursor of the amorphous polyester. Specific examples of usable amines include, but are not limited to, diamines, tri- or more valent polyamines, amino alcohols, amino mercaptans, amino acids, and these compounds in which the amino group is blocked.

Specific examples of suitable diamines include, but are not limited to, aromatic diamines (e.g., phenylenediamine, diethyltoluenediamine, 4,4'-diaminodiphenylmethane), alicyclic diamines (e.g., 4,4'-diamino-3,3'-dimethyldicyclohexylmethane, diaminocyclohexane, isophoronediamine), and aliphatic diamines (e.g., ethylenediamine, tetramethylenediamine, hexamethylenediamine). Specific examples of suitable tri- or more valent polyamines include, but are not limited to, diethylenetriamine and triethylenetetramine. Specific examples of suitable amino alcohols include, but are not limited to, ethanolamine and hydroxyethylaniline. Specific examples of suitable amino mercaptans include, but are not limited to, aminoethyl mercaptan and aminopropyl mercaptan. Specific examples of suitable amino acids include, but are not limited to, aminopropionic acid and aminocaproic acid. Specific examples of the compounds in which the amino group is blocked include, but are not limited to, ketimine compounds obtained from an amine and a ketone (e.g., acetone, methyl ethyl ketone, methyl isobutyl ketone), and oxazoline compounds. Among these amines, a diamine alone and a mixture of a diamine with a small amount of a polyamine are preferable.

The toner may further include an amorphous unmodified polyester. Preferably, the above-described precursor that is a modified polyester and the unmodified polyester are at least partially compatible with each other so as to improve low-temperature fixability and hot offset resistance. Therefore, polyols and polycarboxylic acids that composing the modified polyester are preferably similar to those composing the unmodified polyester.

The toner further includes a crystalline polyester. The crystalline polyester rapidly reduces its viscosity at around the endothermic peak temperature to be described in detail below. The toner can keep heat-resistant storage stability at temperatures below the melting starting temperature owing to such thermal property of the crystalline polyester, while rapidly reduces viscosity at the melting starting temperature to be fixed on a recording medium. Thus, the toner can provide both heat-resistant storage stability and low-temperature fixability.

The crystalline polyester preferably has a sharp endothermic curve in which an endothermic peak exists within a temperature range between 60 and 110° C. This results in a toner having low-temperature fixability and heat-resistant storage stability. More preferably, the endothermic peak exists within a temperature range between 65 and 75° C. to more improve low-temperature fixability and heat-resistant storage stability of the toner. The endothermic peak is determined from an endothermic curve obtained in the first heating in differential scanning calorimetry (DSC).

Preferably, the difference between an endothermic peak temperature (T1-cp) and each of a first endothermic shoulder temperature (T1-cs1) and a second endothermic shoulder temperature (T1-cs2) is as small as possible. The smaller the difference, the smaller variation in molecular composition and weight distribution of the crystalline polyester. Such a crystalline polyester rapidly reduces its viscosity at around the endothermic peak temperature, thus improving low-temperature fixability of the toner.

When the difference between the endothermic peak temperature (T1-cp) and the first endothermic shoulder temperature (T1-cs1) is less than 10, more preferably less than 6, the toner has improved heat-resistant storage stability and blocking resistance.

When the difference between the endothermic peak temperature (T1-cp) and the second endothermic shoulder temperature (T1-cs2) is less than 10, more preferably less than 6, the toner has improved low-temperature fixability. The smaller the difference, the smaller the amount of high-thermal-property components present in the crystalline polyester.

The endothermic peak temperature (T1-cp) can be controlled by changing monomer composition or weight average molecular weight of the crystalline polyester. The difference between the endothermic peak temperature (T1-cp) and the first or second endothermic shoulder temperature (T1-cs1) or (T1-cs2) can be made much smaller by increasing crystallinity of the crystalline polyester. This can be achieved by obtaining the crystalline polyester from acid and alcohol monomers which are similar in composition. In this case, portions having an identical structure in molecular chains overlap with each other at a high probability, resulting in high crystallinity. Additionally, the difference between the endothermic peak temperature (T1-cp) and the first or second endothermic shoulder temperature (T1-cs1) or (T1-cs2) can be made much smaller by reducing the difference between the number and weight average molecular weights of the crystalline polyester.

The crystalline polyester is preferably obtained from an alcohol such as a saturated aliphatic diol having 2 to 12 carbon atoms (e.g., 1,4-butanediol, 1,6-hexanediol, 1,8-octanediol, 1,10-decanediol, 1,12-dodecanediol, and derivatives thereof) and an acid such as a dicarboxylic acid having a C=C double bond and 2 to 12 carbon atoms or a saturated dicarboxylic acid having 2 to 12 carbon atoms (e.g., fumaric acid, 1,4-butanedioic acid, 1,6-hexanedioic acid, 1,8-octanedioic acid, 1,10-decanedioic acid, 1,12-dodecanedioic acid, and derivatives thereof).

To make the difference between the endothermic peak temperature (T1-cp) and the first or second endothermic shoulder temperature (T1-cs1) or (T1-cs2) much smaller, the crystalline polyester is preferably obtained from one alcohol selected from 1,4-butanediol, 1,6-hexanediol, 1,8-octanediol, 1,10-decanediol, and 1,12-dodecanediol, and one dicarboxylic acid selected from fumaric acid, 1,4-butanedioic acid, 1,6-hexanedioic acid, 1,8-octanedioic acid, 1,10-decanedioic acid, and 1,12-dodecanedioic acid.

The crystalline polyester preferably has an acid value of 5 mgKOH/g or more, more preferably 10 mgKOH/g or more, to improve affinity for paper to improve low-temperature fixability. On the other hand, the crystalline polyester preferably has an acid value of 45 mgKOH/g or less to improve hot offset resistance.

The crystalline polyester preferably has a hydroxyl value of 0 to 50 mgKOH/g, more preferably 5 to 50 mgKOH/g, to improve low-temperature fixability and chargeability.

Molecular structure of the crystalline polyester can be determined by liquid NMR, solid NMR, X-ray diffraction, GC/MS, LC/MS, or IR, for example. One exemplary method for determining molecular structure includes observing an infrared absorption spectrum to determine whether the spectrum has an absorption peak based on δCH (out-of-plane bending vibration) of olefin at 965±10 $cm^{-1}$ or 990±10 $cm^{-1}$.

It is known that a resin having a narrow molecular weight distribution and a low average molecular weight has low-temperature fixability, and that including a large amount of low-molecular-weight components has poor heat-resistant storage stability. In view of this, a molecular weight (M) distribution chart obtained by gel permeation chromatography, having the lateral axis indicating "log(M)" and the vertical axis indicating "% by weight", of o-dichlorobenzene-soluble components in the crystalline polyester preferably has a peak having a half bandwidth of 1.5 or less within a lateral range log(M) of from 3.5 to 4.0. Additionally, it is preferable that the weight average molecular weight (Mw) is from 3,000 to 30,000, the number average molecular weight (Mn) is from 1,000 to 10,000, and the ratio Mw/Mn is from 1 to 10. It is more preferable that the weight average molecular weight (Mw) is from 5,000 to 15,000, the number average molecular weight (Mn) is from 2,000 to 10,000, and the ratio Mw/Mn is from 1 to 5.

Also, properties of the crystalline polyester, such as crystallinity, softening point, and hot offset resistance, are easy to control when the crystalline polyester is a non-linear polyester obtained from polycondensation between a polyol having 3 or more valences (e.g., glycerin) as the alcohol component and a polycarboxylic acid having 3 or more valences (e.g., trimellitic anhydride) as the acid component.

FIG. 1 shows an exemplary differential scanning calorimetric (hereinafter "DSC") chart of the crystalline polyester. The endothermic peak temperatures and endothermic shoulder temperatures of the crystalline polyester, amorphous polyester, and toner can be measured using a differential scanning calorimeter system DSC-60 (Shimadzu Corporation) as follows. First, about 5.0 mg of a sample is contained in an aluminum container, and the container is put on a holder unit to be set in an electric furnace. The sample is heated from 0° C. to 150° C. at a heating rate of 10° C./min under nitrogen atmosphere, and subsequently cooled from 150° C. to 0° C. at a cooling rate of 10° C./min, while the differential scanning calorimeter system DSC-60 measuring a DSC curve. An analysis software program in the DSC-60 analyzes the first and second endothermic shoulder temperatures (T1-cs1) and (T1-cs2) in the DSC curve obtained in the heating.

The weight ratio of the crystalline polyester to the amorphous polyester in the toner is preferably 10/90 to 35/65.

Specific examples of usable colorants include, but are not limited to, carbon black, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

The toner can be used as process color toners, i.e., black, cyan, magenta, and yellow toners. The black toner preferably includes a carbon black. The cyan toner preferably includes C. I. Pigment Blue 15:3. The magenta toner preferably includes C. I. Pigment Red 122, C. I. Pigment Red 269, and/or C. I. Pigment Red 81:4. The yellow toner preferably includes C. I. Pigment Yellow 74, C. I. Pigment Yellow 155, C. I. Pigment Yellow 180, and/or C. I. Pigment Yellow 185.

From the viewpoint of color reproducibility and preservative quality of image, a combination of a black toner including a carbon black, a cyan toner including C. I. Pigment Blue 15:3, a magenta toner including a mixture of C. I. Pigment Red 122 and C. I. Pigment Red 269, and a yellow toner including C. I. Pigment Yellow 185 is preferable.

The ratio of C. I. Pigment Red 122 to C. I. Pigment Red 269 in the mixture is preferably 5/95 to 80/20. When the ratio is less than 5/95, the toner may not express magenta color. When the ratio is greater than 80/20, coloring power of the toner may be poor.

The colorant content in the toner is preferably 3 to 12% by weight based on total weight of toner. When the colorant content in the toner is too small, the toner may be wasted because coloring power is so poor. When the colorant content in the toner is too large, the colorant may adversely affect charge stability of the toner. Thus, the colorant content is more preferably 5 to 10% by weight.

The colorant content (A) in the amorphous polyester is preferably 7% by weight or less, more preferably 3 to 7% by weight, based on total weight of the amorphous polyester and the colorant dispersed therein. Additionally, the colorant content (C) in the crystalline polyester domains based on total weight of the crystalline polyester and the colorant dispersed therein is preferably greater than the colorant content (A) in the amorphous polyester. When the colorant content (A) in the amorphous polyester is too small, coloring power may be poor. When the colorant content (A) in the amorphous polyester is too large, the amorphous polyester expresses too large an elasticity to satisfactorily extend at around fixing temperatures, resulting in nonuniform and low image gloss.

Preferably, the colorant is dispersed in the crystalline polyester by an open roll kneader, for example, to be used as a master batch. The master batch may be dispersed in an organic solvent or an amorphous polyester varnish by a bead mill, and the resulting dispersion may be added to the oil phase. Thus, the colorant can be dispersed in the crystalline polyester domains in the resulting toner.

The crystalline polyester master batch is preferably dispersed in the toner forming domains having a dispersion diameter of 2 μm or less, more preferably 1 μm or less. When the dispersion diameter is too large, it may be difficult to encapsulate the domains in the toner and the crystalline polyester may not well function as fixing-auxiliary agent because the interface area between the amorphous polyester is too small. Additionally, the dispersion diameter is preferably 0.3 μm or more, more preferably 0.5 μm or more. When the dispersion diameter is too small, the master batch may easily dissolves in an organic solvent or an amorphous polyester varnish. If the crystalline polyester is dissolved in the amorphous polyester, heat-resistant storage stability of the toner deteriorates because the glass transition temperature of the toner is lowered.

The master batch in which the colorant is dispersed in the crystalline polyester is less soluble in an organic solvent or an amorphous polyester varnish than the crystalline polyester itself. This prevents the crystalline polyester from dissolving in the amorphous polyester through toner manufacturing process.

The colorant may be also dispersed in the amorphous polyester by an open roll kneader, a two-roll mill, or a three-roll mill, for example, to be used as a master batch. The master batch may be dissolved in an organic solvent or an amorphous polyester varnish, or dispersed in an amorphous polyester varnish previously dissolved in an organic solvent by a bead mill or NANOMIZER (from Yoshida Kikai Co., Ltd.).

The ratio of the colorant to resins in the crystalline polyester master batch is preferably greater than that in the toner.

The toner may further include a release agent. The release agent may be, for example, a wax having a melting point of 50 to 120° C. The wax effectively functions at an interface between a fixing roller and the toner. Thus, there is no need to apply a release oil to the fixing member. Melting points of waxes can be determined from the maximum endothermic peak measured by a differential scanning colorimeter TG-DSC system TAS-100 (Rigaku Corporation).

Specific preferred examples of suitable release agents include, but are not limited to, natural waxes such as plant waxes (e.g., carnauba wax, cotton wax, sumac wax, rice wax), animal waxes (e.g., bees wax, lanolin), mineral waxes (e.g., ozokerite, ceresin), and petroleum waxes (e.g., paraffin wax, micro-crystalline wax, petrolatum wax); synthetic hydrocarbon waxes such as Fischer-Tropsch wax and polyethylene wax; and synthetic waxes of esters, ketone, and ethers. Further, the following materials are also suitable for the release agent: fatty acid amides such as 1,2-hydroxystearic acid amide, stearic acid amide, phthalic anhydride imide, and chlorinated hydrocarbon; and crystalline polyesters such as a homopolymer or copolymer of a polyacrylate (e.g., n-stearyl polymethacrylate, n-lauryl polymethacrylate) having a long alkyl side chain.

The release agent content in the toner is preferably 2 to 20% by weight, and more preferably 3 to 12% by weight. When the release agent content is too small, the toner may have poor releasability. When the release agent content is too large, the toner may degrade its chargeability and contaminate developing members and photoreceptor.

The toner may further include a charge controlling agent. Specific preferred examples of suitable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives.

Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LRA-901, and LR-147 (boron complex), which are manufactured by Japan Carlit Co., Ltd.; and cooper phthalocyanine, perylene, quinacridone, azo pigments, and polymers having a functional group such as a sulfonate group, a carboxyl group, and a quaternary ammonium group.

The content of the charge controlling agent is preferably 0.1 to 10 parts by weight, more preferably 0.2 to 5 parts by weight, based on 100 parts by weight of the binder resin. When the content of charge controlling agent is too large, the toner may be excessively charged and electrostatically attracted to a developing roller, resulting in poor fluidity of the developer and low image density.

The charge controlling agent may be directly mixed with the binder resin or the master batch, or added to an organic solvent containing such toner components. Alternatively, the charge controlling agent may be fixed on the surface of the resulting toner particles.

The oil phase for preparing the toner contains an organic solvent which uniformly dissolves the amorphous polyester but dissolves at most 1% of the crystalline polyester at below normal temperatures. Specific examples of such organic solvents include, but are not limited to, toluene, ethyl acetate, butyl acetate, methyl ethyl ketone, and methyl isobutyl ketone. Two or more of these solvents can be used in combination.

The toner may further include an external additive on the surface thereof to improve fluidity, developability, and chargeability. Particulate inorganic materials are preferably used as the external additive. The particulate inorganic material preferably has a primary diameter of 5 nm to 2 μm, and more preferably 5 nm to 500 nm. The particulate inorganic material preferably has a BET specific surface of 2 to 500 $m^2/g$. The content of the particulate inorganic material is preferably 0.01 to 5% by weight, and more preferably 0.01 to 2.0% by weight.

Specific preferred examples of suitable particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

Additionally, particles of polymers prepared by soap-free emulsion polymerization, suspension polymerization, or dispersion polymerization (e.g., polystyrene, copolymers of methacrylates or acrylates), polycondensation polymers (e.g., silicone, benzoguanamine, nylon), and thermosetting resins are also usable as the external additive.

The surface of the external additive may be hydrophobized so that deterioration of fluidity and chargeability can be prevented even under high-humidity conditions. Specific preferred examples of suitable surface treatment agents include, but are not limited to, silane coupling agents, silylation agents, silane coupling agents having a fluorinated alkyl group, organic titanate coupling agents, aluminum coupling agents, silicone oils, and modified silicone oils.

The toner may further include a cleanability improving agent so as to be easily removable from a photoreceptor or a primary transfer medium when remaining thereon after image transfer. Specific preferred examples of suitable cleanability improving agents include, but are not limited to, metal salts of fatty acids (e.g., zinc stearate, calcium stearate), and fine particles of polymers prepared by soap-free emulsion polymerization (e.g., polymethyl methacrylate, polystyrene). Such fine particles of polymers preferably have a narrow size distribution and a volume average particle diameter of 0.01 to 1 μm.

The aqueous medium for preparing the toner may be, for example, water alone or a mixture of water with a water-miscible solvent. Specific preferred examples of suitable water miscible solvents include, but are not limited to, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone).

The components, such as the amorphous polyester or a precursor thereof, the crystalline polyester, a colorant, a release agent, a charge controlling agent, and an unmodified polyester, may be mixed at the time they are dispersed in the aqueous medium. However, it is more preferable that the toner components are previously mixed with each other and the resulting mixture is then dispersed in the aqueous medium.

The amount of the aqueous medium is preferably 100 to 1,000 parts by weight based on 100 parts by weight of the toner components. When the amount of the aqueous medium is too small, the toner components may not be finely dispersed, and the resulting toner particles may not have a desired particle size. When the amount of the aqueous medium is too large, manufacturing cost may increase.

The aqueous medium preferably contains a dispersant. The dispersant stabilizes the dispersion and makes the resulting particles have a narrower size distribution.

The polyester prepolymer may be previously reacted with the compound having an active hydrogen group before they are added to the aqueous medium. Alternatively, the compound having an active hydrogen group may be added to the aqueous medium after the toner components including the polyester prepolymer are dispersed therein. In the latter case, the resulting urea-modified polyester resin is dominantly formed at the surface of the toner particle, generating a concentration gradient of urea bonds within the toner particle.

When an oil phase containing the toner components is dispersed in the aqueous medium, a dispersant can be used. Specific preferred examples of suitable dispersants include, but are not limited to, anionic surfactants such as α-olefin sulfonate and phosphates; cationic surfactants such as amine salt type surfactants (e.g., alkylamine salts, amino alcohol fatty acid derivatives, polyamine fatty acid derivatives, imidazoline) and quaternary ammonium salt type surfactants (e.g., alkyl trimethyl ammonium salt, dialkyl dimethyl ammonium salt, alkyl dimethyl benzyl ammonium salt, pyridinium salt, alkyl isoquinolinium salt, and benzethonium chloride); nonionic surfactants such as fatty acid amide derivatives and polyvalent alcohol derivatives; and ampholytic surfactants such as alanine, dodecyldi(aminoethyl)glycine, and N-alkyl-N,N-dimethyl ammonium betaine.

Surfactants having a fluoroalkyl group can achieve an effect in a small amount. Specific preferred examples of suitable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11) oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12)sulfonic acids and metal salts thereof, perfluorooctane sulfonic acid dimethanol amide, N-propyl-N-(2-hydroxyethyl)perfluorooctane sulfonamide, perfluoroalkyl(C6-C10)sulfonamide propyl trimethyl ammonium salts, perfluoroalkyl(C6-C10)-N-ethyl sulfonyl glycine salts, and monoperfluoroalkyl(C6-C16)ethyl phosphates.

Specific examples of commercially available such anionic surfactants having a fluoroalkyl group include, but are not limited to, SURFLON® S-111, S-112, and S-113 (from AGC Seimi Chemical Co., Ltd.); FLUORAD FC-93, FC-95, FC-98, and FC-129 (from Sumitomo 3 M); UNIDYNE DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

Specific preferred examples of suitable cationic surfactants having a fluoroalkyl group include, but are not limited to, aliphatic primary, secondary, and tertiary amine acids having a fluoroalkyl group, aliphatic quaternary ammonium salts such as perfluoroalkyl(C6-C10) sulfonamide propyl trimethyl ammonium salts, benzalkonium salts, benzethonium chlorides, pyridinium salts, and imidazolinium salts. Specific examples of commercially available cationic surfactants having a fluoroalkyl group include, but are not limited to, SURFLON® S-121 (from AGC Seimi Chemical Co., Ltd.); FLUORAD FC-135 (from Sumitomo 3M); UNIDYNE DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

Additionally, poorly-water-soluble inorganic compounds, such as tricalcium phosphate, calcium carbonate, titanium oxide, colloidal silica, and hydroxyapatite, are also usable.

Dispersed oil droplets may be stabilized by a polymeric protection colloid or a water-insoluble particulate organic material. Specific examples of usable polymeric protection colloids include, but are not limited to, homopolymers and copolymers obtained from monomers, such as acids (e.g., acrylic acid, methacrylic acid, α-cyanoacrylic acid, α-cyanomethacrylic acid, itaconic acid, crotonic acid, fumaric acid, maleic acid, maleic anhydride), hydroxyl-group-containing acrylates and methacrylates (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate), vinyl alcohols and vinyl alcohol ethers (e.g., vinyl methyl ether, vinyl ethyl ether, vinyl propyl ether), esters of vinyl alcohols with carboxyl-group-containing compounds (e.g., vinyl acetate, vinyl propionate, vinyl butyrate), amides (e.g., acrylamide, methacrylamide, diacetone acrylamide) and methylol compounds thereof (e.g., N-methylol acrylamide, N-methylol methacrylamide), acid chlorides (e.g., acrylic acid chloride, methacrylic acid chloride), and monomers containing nitrogen or a nitrogen-containing heterocyclic ring (e.g., vinyl pyridine, vinyl pyrrolidone, vinyl imidazole, ethylene imine); polyoxyethylenes (e.g., polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, polyoxyethylene nonyl phenyl ester); and celluloses (e.g., methyl cellulose, hydroxyethyl cellulose, hydroxypropyl cellulose).

In a case in which a dispersant soluble in acids and bases (e.g., calcium phosphate) is used, the resulting toner particles are first washed with an acid (e.g., hydrochloric acid) and then washed with water to remove the dispersant. Alternatively, such a dispersant can be removed with an enzyme. Dispersants can remain on the surface of the toner, however, it is more preferable that the dispersants are removed from the toner surface in terms of chargeability.

To further reduce the viscosity of the toner components, solvents which can dissolve the modified polyester resulted from the polyester prepolymer are usable. When such a solvent is used, the resulting particles have a narrower size distribution.

Volatile solvents having a boiling point less than 100° C. are preferable because they are easily removable. Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these solvents can be used in combination. Among these solvents, aromatic solvents (e.g., toluene, xylene) and halogenated hydrocarbons (e.g., methylene chloride, 1,2-dichloroethane, chloroform, carbon tetrachloride) are preferable.

The amount of the solvent is preferably 0 to 300 parts by weight, more preferable 0 to 100 parts by weight, and most preferably 25 to 70 parts by weight, based on 100 parts by weight of the polyester prepolymer. The solvent is removed by application of heat at normal or reduced pressures after the termination of the elongation and/or cross-linking reaction.

The elongation and/or cross-linking reaction time between the polyester prepolymer and the compound having an active hydrogen group is preferably 10 minutes to 40 hours, and more preferably from 30 minutes to 24 hours. The reaction temperature is preferably 0 to 100° C., and more preferably 10 to 50° C. A catalyst can be used, if needed. Specific examples of usable catalysts include, but are not limited to, tertiary amines (e.g., triethylamine) and imidazole.

The solvent can be removed from the dispersion by gradually heating the dispersion to completely evaporate the solvent from liquid droplets. Alternatively, the solvent can be removed from the dispersion by spraying the dispersion into dry atmosphere to completely evaporate the solvent from liquid droplets. In the latter case, aqueous dispersants, if any, can also be evaporated. The dry atmosphere into which the dispersion is sprayed may be, for example, air, nitrogen gas, carbon dioxide gas, or combustion gas, which is heated to above the maximum boiling point among the solvents. Such a treatment can be reliably performed by a spray drier, a belt drier, or a rotary kiln, within a short period of time.

In a case in which the dispersion is subjected to washing and drying treatments while containing toner particles having a wide size distribution, the toner particles are preferably subjected to a classification treatment thereafter. Specifically, the classification treatment removes undesired-size particles from the resulting particles in a liquid by a cyclone, a decanter, or a centrifugal separator. Of course, the classification treatment can be performed after drying the resulting particles, but is more effectively performed in a liquid. The collected undesired-size particles, either in dry or wet condition, can be reused for preparation of toner particles. The dispersant is preferably removed from the dispersion as much as possible.

The dried toner particles are optionally mixed with fine particles of a release agent, a charge controlling agent, a fluidizer, and/or a colorant, and these fine particles can be fixedly adhered to the surfaces of the toner particles by application of mechanical impulsive force. Mechanical impulsive force can be applied by agitating toner particles using blades rotating at a high speed, or accelerating toner particles by a high-speed airflow to collide with a collision plate. Such a treatment can be performed by ONG MILL (from Hosokawa Micron Co., Ltd.), a modified I-TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

The toner may be used for either one-component developers or two-component developers. The two-component developer preferably includes 100 parts by weight of a magnetic carrier and 1 to 10 parts by weight of the toner. Specific preferred materials suitable for the magnetic carrier include, but are not limited to, iron powder, ferrite powder, magnetite powder, and magnetic resin carrier, having a particle diameter of 20 to 200 μm. Specific preferred examples of suitable covering materials for the magnetic carrier include, but are not limited to, amino resins (e.g., urea-formaldehyde resin, melamine resin, benzoguanamine resin, urea resin, polyamide resin, epoxy resin), polyvinyl and polyvinylidene resins (e.g., acrylic resin, polymethyl methacrylate resin, polyacrylonitrile resin, polyvinyl acetate resin, polyvinyl alcohol resin, polyvinyl butyral resin), styrene resins (e.g., polystyrene resin, styrene-acrylic copolymer resin), halogenated olefin resins (e.g., polyvinyl chloride), polyester resins (e.g., polyethylene terephthalate, polybutylene terephthalate), polycarbonate resins, polyethylene resins, polyvinyl fluoride resins, polyvinylidene fluoride resins, poly(trifluoroethylene) resins, poly(hexafluoropropylene) resins, vinylidene fluoride-acrylic copolymer, vinylidene fluoride-vinyl fluoride copolymer, tetrafluoroethylene-vinylidene fluoride-nonfluoride monomer terpolymer, and silicone resins. The covering material may contain a conductive powder therein. Specific preferred examples of suitable conductive powders include, but are not limited to, metal, carbon black, titanium oxide, tin oxide, and zinc oxide. The conductive powder preferably has an average particle diameter of 1 μm or less. When the average particle diameter is too large, it may be difficult to control electric resistivity of the resin layer. The toner may be either a magnetic or non-magnetic to be used as a one-component developer.

Exemplary aspects of the present invention further provides an image forming method including a charging step in which an image bearing member is charged; a developing step in which an electrostatic latent image formed on the image bearing member is developed into a toner image with the above-described one-component or two-component developer; a transfer step in which the toner image is transferred from the image bearing member onto a recording medium; and a fixing step in which the toner image is fixed on the recording medium. The image bearing member preferably bears a single toner in an amount of 0.4 mg/cm$^2$ or less. When the amount of single toner on the image bearing member is too large, it means that the colorant content in the toner is too small, resulting in wasteful consumption of the toner. The image forming method reliably and continuously produces high-quality high-density images without image density unevenness and background fouling.

Figure 2:
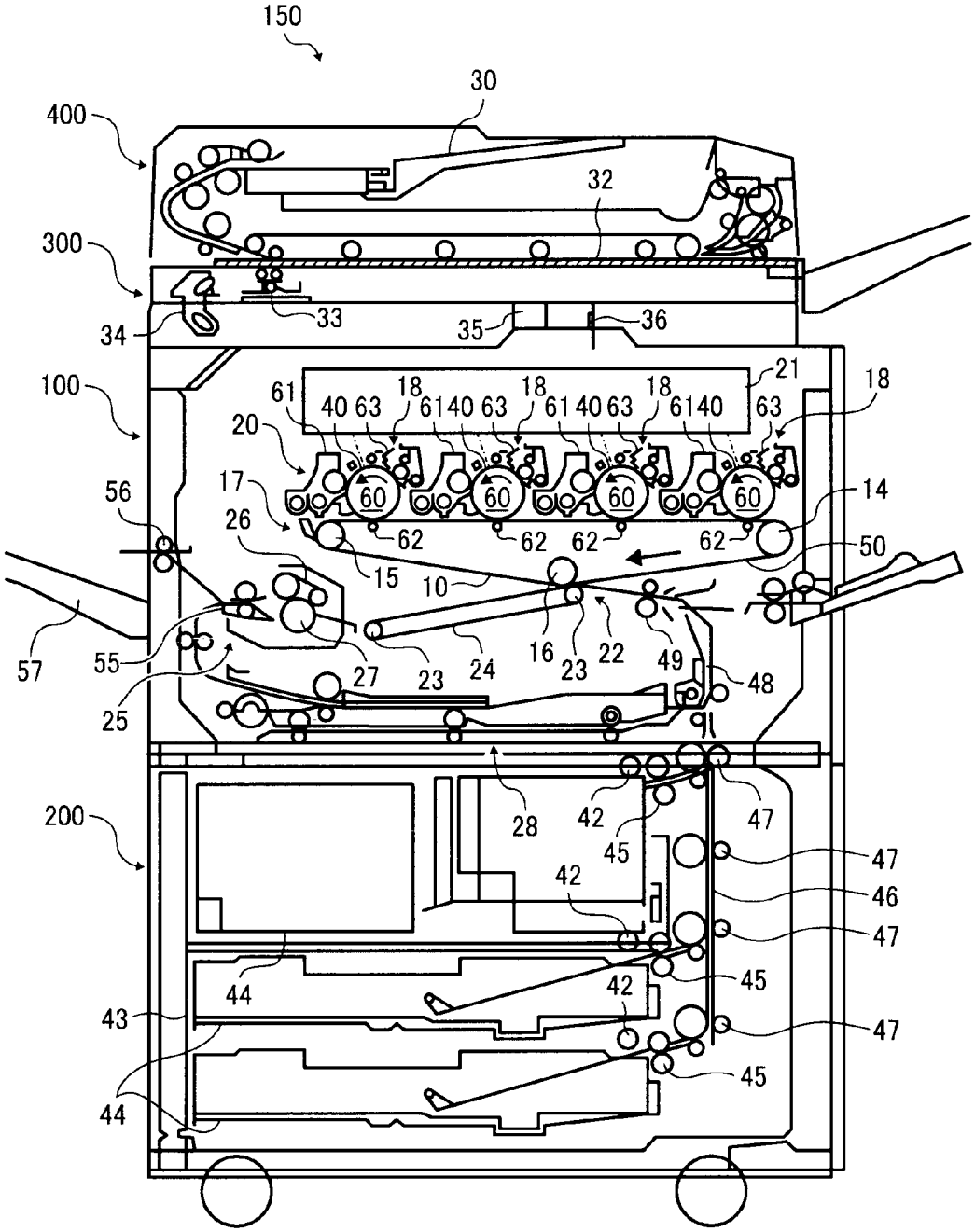
FIG. 2 is a schematic view illustrating an image forming apparatus according to exemplary embodiments of the invention.

FIG. 2 is a schematic view illustrating an image forming apparatus according to exemplary embodiments of the invention. An image forming apparatus 150 illustrated in FIG. 2 is an electrophotographic copier employing a tandem indirect transfer method and the two-component developer according to the present invention. The image forming apparatus 150 includes a main body 100, a paper feed table 200 provided below the main body 100, a scanner (i.e., a reading optical system) 300 provided above the main body 100, and an automatic document feeder (ADF) 400 provided above the scanner 300.

An intermediate transfer member 10 that is a laterally-stretched seamless belt is provided at the center of the main body 100. The intermediate transfer member 100 is stretched across support rollers 14, 15, and 16 to be rotatable clockwise in FIG. 2. An intermediate transfer member cleaner 17 that removes residual toner particles remaining on the intermediate transfer member 10 is provided on the left side of the support roller 15 in FIG. 2. Image forming units 18 each produce respective images of black, yellow, magenta, and cyan are provided along a stretched surface of the intermediate transfer member 10 between the support rollers 14 and 15, thus forming a tandem image forming part 20. An irradiator 21 is provided immediately above the tandem image forming part 20.

A secondary transfer device 22 is provided on the opposite side of the tandem image forming part 20 relative to the intermediate transfer member 10. The secondary transfer device 22 includes a secondary transfer belt 24 that is a seamless belt stretched between two rollers 23. The secondary transfer belt 24 is pressed against the support roller 16 with the intermediate transfer member 10 therebetween so that an image is transferred from the intermediate transfer member 10 onto a sheet of a recording medium. A fixing device 25 that fixes a toner image on the sheet is provided adjacent to the secondary transfer device 22. The fixing device 25 includes a fixing belt 26 that is a seamless belt and a pressing roller 27. The fixing belt 26 is pressed against the pressing roller 27. The secondary transfer device 22 has a function of feeding the sheet having the toner image thereon to the fixing device 25. A sheet reversing device 28 that reverses a sheet upside down is provided below the secondary transfer device 22 and the fixing device 25 and in parallel with the tandem image forming part 20.

To make a copy, a document is set on a document table 30 of the automatic document feeder 400. Alternatively, a document is set on a contact glass 32 of the scanner 300 while lifting up the automatic document feeder 400, followed by holding down of the automatic document feeder 400. Upon pressing of a switch, in a case in which a document is set on the contact glass 32, the scanner 300 immediately starts driving so that a first runner 33 and a second runner 34 start moving. In a case in which a document is set on the automatic document feeder 400, the scanner 300 starts driving after the document is fed onto the contact glass 32. The first runner 33 emits light from its light source and reflects light reflected from the surface of the document toward the second runner 34. A mirror in the second runner 34 reflects the light toward a reading sensor 36 through an imaging lens 35. On the other hand, upon pressing of the switch, one of the support rollers 14, 15, and 16 is driven to rotate by a driving motor and the other two support rollers are driven to rotate by rotation of the rotating support roller so as to rotate and convey the intermediate transfer member 10. In the image forming units 18, respective single-color toner images of black, yellow, magenta, and cyan are formed on each photoreceptor 40. The single-color toner images are sequentially transferred onto the intermediate transfer member 10 along conveyance of the intermediate transfer member 10 to form a composite full-color toner image thereon. On the other hand, upon pressing of the switch, one of paper feed rollers 42 starts rotating in the paper feed table 200 so that a sheet of a recording paper is fed from one of paper feed cassettes 44 in a paper bank 43. The sheet is separated by one of separation rollers 45 and fed to a paper feed path 46. Feed rollers 47 feed the sheet to a paper feed path 48 in the main body 100. The sheet is stopped by a registration roller 49. The registration roller 49 feeds the sheet to between the intermediate transfer member 10 and the secondary transfer device 22 in synchronization with an entry of the composite full-color toner image formed on the intermediate transfer member 10. The sheet is then fed to the fixing device 25 so that the composite full-color toner image is fixed thereon by application of heat and pressure. The sheet having the fixed toner image is switched by a switch claw 55 and discharged onto a discharge tray 57 by a discharge roller 56. Alternatively, the switch claw 55 switches paper feed paths so that the sheet gets reversed in the sheet reversing device 28. After forming another toner image on the back side of the sheet, the sheet is discharged onto the discharge tray 57 by rotating the discharge roller 56. On the other hand, the intermediate transfer member cleaner 17 removes residual toner particles remaining on the intermediate transfer member 10 without being transferred. Thus, the tandem image forming part 20 gets ready for next image formation.

Figure 3:
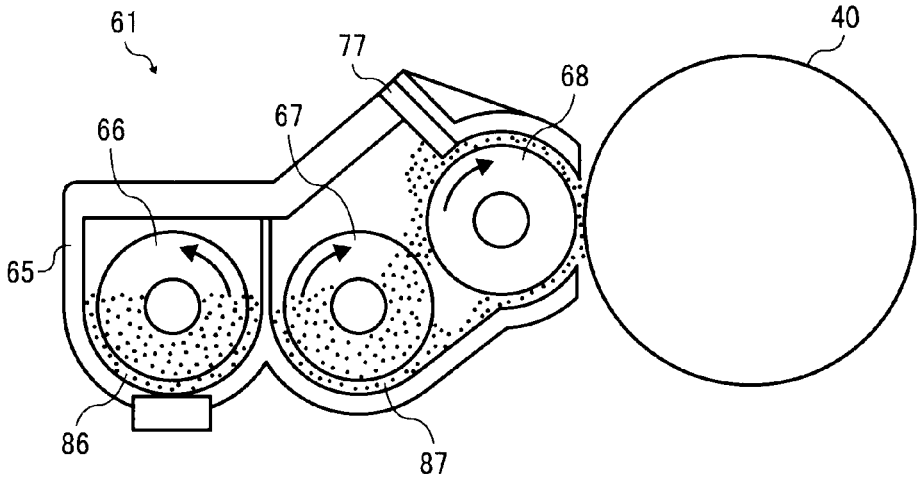
FIG. 3 is a magnified schematic view illustrating the developing device included in the image forming apparatus illustrated in FIG. 2.
Figure 4:
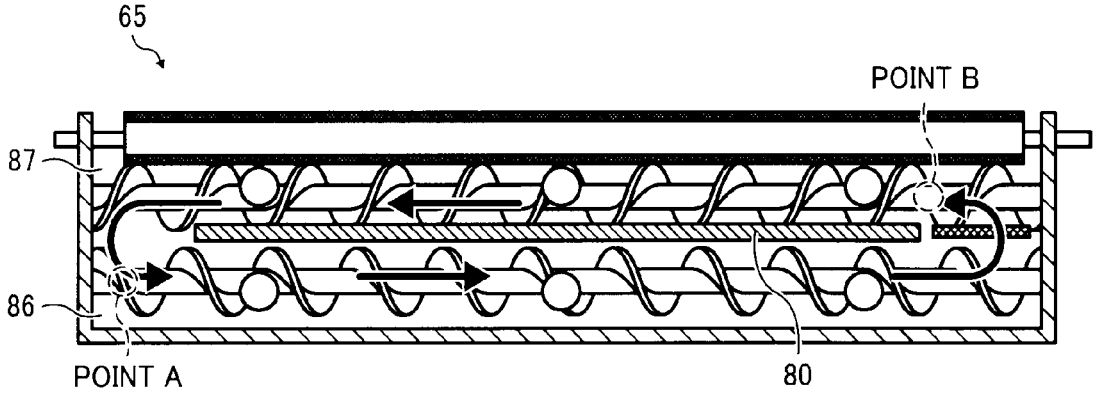
FIG. 4 is an axial sectional view illustrating the developer container included in the developing device illustrated in FIG. 3.

Each image forming unit 18 includes a photoreceptor 40. Around the photoreceptor 40, a charger 60, a developing device 61, a primary transfer device 62, and a photoreceptor cleaner 63 having a blade member are provided. FIG. 3 is a magnified schematic view illustrating the developing device 61. The developing device 61 includes a developer container 65. Within the developer container 65, agitation screws 66 and 67, a developing roller 68, and a doctor blade 77 are provided. A first developer agitation chamber 86 has a supply opening on its outer wall through which toner is supplied from a toner supplying device. The agitation screw 66 agitates and feeds the toner supplied from the toner supplying device and two-component developer (having magnetic carrier particles and toner particles) contained in the developer container 65. The agitation screw 67 provided in a second developer agitation chamber 87 agitates and feeds developer contained in the developer container 65. Hereinafter, the first and second developer agitation chambers 86 and 87 may be respectively referred to as toner-supplying-side and developing-side agitation chambers. FIG. 4 is an axial sectional view illustrating the developer container 65. The toner-supplying-side agitation chamber 86 and developing-side agitation chamber 87 are divided by a division plate 80 as illustrated in FIG. 4. A toner supply opening A and a toner passing opening B are provided on the both ends. Developer in the developing-side agitation chamber 87 is supplied to a gap between the photoreceptor 40 and the developing roller 68 while the supplied developer is regulated by the doctor blade 77. The developer receives a large abrasive force from the doctor blade 77.

Figure 5:
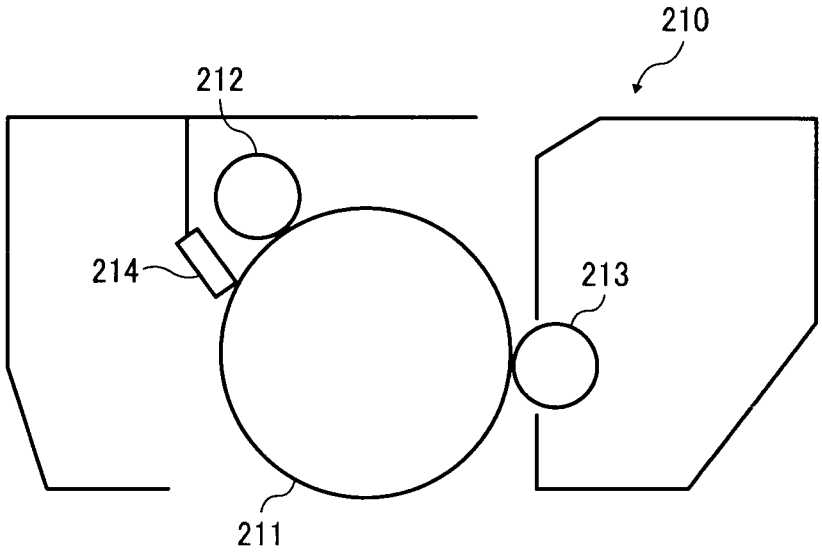
FIG. 5 is a schematic view illustrating a process cartridge according to exemplary embodiments of the invention

FIG. 5 is a schematic view illustrating a process cartridge according to exemplary embodiments of the invention. A process cartridge 210 includes a photoreceptor 211, a charger 212, a developing device 213, and a cleaner 214. The process cartridge is detachably mountable on image forming apparatuses.

In an image forming apparatus on which the process cartridge is mounted, the photoreceptor 211 is driven to rotate at a predetermined peripheral speed. A peripheral surface of the photoreceptor 211 is uniformly charged to a predetermined positive or negative potential and then exposed to light containing image information emitted from an irradiator such as a slit irradiator or a laser beam scanning irradiator. Thus, an electrostatic latent image is formed on the peripheral surface of the photoreceptor 211 and developed into a toner image. The toner image is transferred onto a transfer material which has been timely fed to between the photoreceptor 212 and a transfer device. The transfer material having the toner image thereon is separated from the peripheral surface of the photoreceptor 212 and introduced into a fixing device. The transfer material having the fixed toner image thereon is discharged from the image forming apparatus as a copy. The cleaner 214 removes residual toner particles remaining on the peripheral surface of the photoreceptor 211 without being transferred. The cleaned photoreceptor 211 is neutralized to be ready for a next image forming operation.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Crystalline Polyester Master Batches

Preparation of Yellow Master Batch A

C. I. Pigment Yellow 185 (D1155 from BASF) in an amount of 100 parts, a crystalline polyester A (RN-248 from Kao Corporation, having an endothermic peak of 67° C. and a weight average molecular weight of 20,000, composed mainly of sebacic acid and 1,6-hexanediol) in an amount of 400 parts, and ion-exchange water in an amount of 30 parts are mixed in a polyethylene bag. The mixture is kneaded twice by an open roll kneader (KNEADEX from Nippon Coke & Engineering Co., Ltd.) while setting the front roll supply side temperature to 90° C., the front roll discharge side temperature to 50° C., the back roll supply side temperature to 30° C., the back roll discharge side temperature to 20° C., the front roll revolution to 35 rpm, the back roll revolution to 31 rpm, and the gap to 0.25 mm. The kneaded mixture is pulverized by a pulverizer (from Hosokawa Micron Corporation). Thus, a yellow master batch A is prepared.

Preparation of Magenta Master Batch A

The procedure for preparing the yellow master batch A is repeated except for replacing the 100 parts of C. I. Pigment Yellow 185 (D1155 from BASF) with 50 parts of C. I. Pigment Red 122 (RTS from DIC Corporation) and 50 parts of C. I. Pigment Red 269 (K1022 from DIC Corporation). Thus, a magenta master batch A is prepared.

Preparation of Cyan Master Batch A

The procedure for preparing the yellow master batch A is repeated except for replacing the 100 parts of C. I. Pigment Yellow 185 (D1155 from BASF) with 100 parts of C. I. Pigment Blue 15:3 (7531 from Toyo Ink Co., Ltd.). Thus, a cyan master batch A is prepared.

Preparation of Black Master Batch A

The procedure for preparing the yellow master batch A is repeated except for replacing the 100 parts of C. I. Pigment Yellow 185 (D1155 from BASF) with 100 parts of a carbon black (E400R from Cabot Corporation). Thus, a black master batch A is prepared.

Preparation of Yellow Master Batch B

C. I. Pigment Yellow 185 (D1155 from BASF) in an amount of 100 parts, a crystalline polyester B (RNC100 from Kao Corporation, having an endothermic peak of 103° C. and a weight average molecular weight of 14,000, composed mainly of fumaric acid and 1,6-hexanediol) in an amount of 400 parts, and ion-exchange water in an amount of 30 parts are mixed in a polyethylene bag. The mixture is kneaded twice by an open roll kneader (KNEADEX from Nippon Coke & Engineering Co., Ltd.) while setting the front roll supply side temperature to 90° C., the front roll discharge side temperature to 50° C., the back roll supply side temperature to 30° C., the back roll discharge side temperature to 20° C., the front roll revolution to 35 rpm, the back roll revolution to 31 rpm, and the gap to 0.25 mm. The kneaded mixture is pulverized by a pulverizer (from Hosokawa Micron Corporation). Thus, a yellow master batch B is prepared.

Preparation of Magenta Master Batch B

The procedure for preparing the yellow master batch B is repeated except for replacing the 100 parts of C. I. Pigment Yellow 185 (D1155 from BASF) with 50 parts of C. I. Pigment Red 122 (RTS from DIC Corporation) and 50 parts of C. I. Pigment Red 269 (K1022 from DIC Corporation). Thus, a magenta master batch B is prepared.

Preparation of Cyan Master Batch B

The procedure for preparing the yellow master batch B is repeated except for replacing the 100 parts of C. I. Pigment Yellow 185 (D1155 from BASF) with 100 parts of C. I. Pigment Blue 15:3 (4920 from Dainichiseika Color and Chemicals Mfg. Co., Ltd.). Thus, a cyan master batch B is prepared.

Preparation of Black Master Batch B

The procedure for preparing the yellow master batch B is repeated except for replacing the 100 parts of C. I. Pigment Yellow 185 (D1155 from BASF) with 100 parts of a carbon black (NIPEX 600 from Deggusa). Thus, a black master batch B is prepared.

Dispersion Treatment of Crystalline Polyester Master Batches A and B

A mixture of 100 parts of each master batch and 400 parts of ethyl acetate is subjected to a dispersion treatment using a ball mill (filled with zirconia beads having a diameter of 10 mm) so that the master batch is pulverized into coarse particles having a maximum diameter of 100 μm or less, and subsequent dispersion treatment using LABSTAR LMZ06 from Ashizawa Finetech Ltd. (filled with zirconia beads having a diameter of 1 mm) with a cooling water at 10° C. or less. Each master batch is pulverized into particles having an average particle diameter of 1.0±0.3 μm after being subjected to the dispersion treatments for 4 hours. Thus, yellow, magenta, cyan, and black master batch liquids A and B are prepared.

Preparation of Amorphous Polyester Master Batches

Preparation of Yellow Master Batch C

Water in an amount of 100 parts, C. I. Pigment Yellow 185 (D1155 from BASF) in an amount of 100 parts, and an amorphous polyester A (having a glass transition temperature of 58° C. and a weight average molecular weight of 7,600, composed of ethylene oxide adduct and propylene oxide adduct of bisphenol A, adipic acid, trimellitic acid, and terephthalic acid) in an amount of 400 parts are mixed and agitated. The mixture is kneaded twice by an open roll kneader (KNEADEX from Nippon Coke & Engineering Co., Ltd.) while setting the front roll supply side temperature to 100° C., the front roll discharge side temperature to 80° C., the back roll supply side temperature to 40° C., the back roll discharge side temperature to 30° C., the front roll revolution to 35 rpm, the back roll revolution to 31 rpm, and the gap to 0.25 mm. The kneaded mixture is pulverized by a pulverizer (from Hosokawa Micron Corporation). Thus, a yellow master batch C is prepared.

Preparation of Magenta Master Batch C

The procedure for preparing the yellow master batch C is repeated except for replacing the 100 parts of C. I. Pigment Yellow 185 (D1155 from BASF) with 50 parts of C. I. Pigment Red 122 (RTS from DIC Corporation) and 50 parts of C. I. Pigment Red 269 (K1022 from DIC Corporation). Thus, a magenta master batch C is prepared.

Preparation of Cyan Master Batch C

The procedure for preparing the yellow master batch C is repeated except for replacing the 100 parts of C. I. Pigment Yellow 185 (D1155 from BASF) with 100 parts of C. I. Pigment Blue 15:3 (7531 from Toyo Ink Co., Ltd.). Thus, a cyan master batch C is prepared.

Preparation of Black Master Batch C

The procedure for preparing the yellow master batch C is repeated except for replacing the 100 parts of C. I. Pigment Yellow 185 (D1155 from BASF) with 100 parts of a carbon black (E400R from Cabot Corporation). Thus, a black master batch C is prepared.

Each of the yellow, magenta, cyan, and black master batches C in an amount of 100 parts and ethyl acetate in an amount of 100 parts are mixed to prepare yellow, magenta, cyan, and black master batch liquids C, respectively.

Preparation of Yellow Master Batch Liquids D

C. I. Pigment Yellow 185 (D1155 from BASF) in an amount of 40 parts, an amide-modified polyester (a trial product #314 from DIC Corporation, having a glass transition temperature of 60° C. and a weight average molecular weight of 10,000) in an amount of 160 parts, and ethyl acetate in an amount of 200 parts are mixed and agitated. The mixture is subjected to a dispersion treatment using NANOMIZER (NM2-2000AR from Yoshida Kikai Co., Ltd.) at 200 MPa for 5 cycles. Thus, a yellow master batch liquid D is prepared.

Preparation of Magenta Master Batch D

The procedure for preparing the yellow master batch D is repeated except for replacing the 40 parts of C. I. Pigment Yellow 185 (D1155 from BASF) with 20 parts of C. I. Pigment Red 122 (RTS from DIC Corporation) and 20 parts of C. I. Pigment Red 269 (K1022 from DIC Corporation). Thus, a magenta master batch liquid D is prepared.

Preparation of Cyan Master Batch D

The procedure for preparing the yellow master batch D is repeated except for replacing the 40 parts of C. I. Pigment Yellow 185 (D1155 from BASF) with 40 parts of C. I. Pigment Blue 15:3 (7531 from Toyo Ink Co., Ltd.). Thus, a cyan master batch liquid D is prepared.

Preparation of Black Master Batch D

The procedure for preparing the yellow master batch D is repeated except for replacing the 40 parts of C. I. Pigment Yellow 185 (D1155 from BASF) with 40 parts of a carbon black (E400R from Cabot Corporation). Thus, a black master batch D liquid is prepared.

Preparation of Wax Dispersion

An amorphous polyester A (having a glass transition temperature of 58° C. and a weight average molecular weight of 7,600, composed of ethylene oxide adduct and propylene oxide adduct of bisphenol A, adipic acid, trimellitic acid, and terephthalic acid) in an amount of 100 parts, a paraffin wax (HPE-11 from Nippon Seiro Co., Ltd.) in an amount of 90 parts, and a maleic-acid-modified paraffin wax (P-166 from Chukyo Yushi Co., Ltd.) in an amount of 10 parts are dispersed in 300 parts of ethylene oxide by agitation for 10 minutes by a mixer equipped with agitation blades. The mixture is further subjected to a dispersion treatment by DYNOMILL for 8 hours. The resulting dispersion contains wax particles having a particle diameter of 0.5±0.2 μm.

Preparation of Crystalline Polyester Dispersion

A 2-liter metallic vessel is charged with 100 g of the crystalline polyester A and 300 g of ethyl acetate. The mixture is heated to 75° C. to dissolve the crystalline polyester A in the ethyl acetate, followed by cooling in an ice water bath at a cooling rate of 27° C./min. After adding 500 ml of glass beads having a diameter of 3 mm to the vessel, the mixture in the vessel is subjected to a pulverization treatment for 10 hours using a batch-type sand mill apparatus (from Kanpe Hapio Co., Ltd.). Thus, a crystalline polyester dispersion A is prepared. The crystalline polyester dispersion A is containing crystalline polyester A particles having a particle diameter of 0.7±0.2 μm.

Similarly, a crystalline polyester dispersion B containing the crystalline polyester B is prepared. The crystalline polyester dispersion B contains crystalline polyester B particles having a particle diameter of 0.7±0.2 μm.

Example 1

Preparation of Toner Composition Liquids 1

A yellow toner composition liquid 1 is prepared by mixing 75 parts of the yellow mater batch liquid A, 40 parts of the yellow master batch liquid C, 25 parts of the wax dispersion, 62 parts of an amorphous polyester B (having a glass transition temperature of 63° C. and a weight average molecular weight of 30,000, composed of ethylene oxide adduct and propylene oxide adduct of bisphenol A, terephthalic acid, and isophthalic acid), and 12 parts of ethyl acetate.

A magenta toner composition liquid 1 is prepared by mixing 75 parts of the magenta mater batch liquid A, 50 parts of the magenta master batch liquid C, 25 parts of the wax dispersion, 58 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid), and 8 parts of ethyl acetate.

A cyan toner composition liquid 1 is prepared by mixing 75 parts of the cyan mater batch liquid A, 20 parts of the cyan master batch liquid C, 25 parts of the wax dispersion, 70 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid), and 20 parts of ethyl acetate.

A black toner composition liquid 1 is prepared by mixing 75 parts of the black mater batch liquid A, 50 parts of the black master batch liquid C, 25 parts of the wax dispersion, 58 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid), and 8 parts of ethyl acetate.

Preparation of Resin Particle Dispersion

A reaction vessel equipped with a stirrer and a thermometer is charged with 683 parts of water, 11 parts of a sodium salt of a sulfate of ethylene oxide adduct of methacrylic acid (ELEMINOL RS-30 from Sanyo Chemical Industries, Ltd.), 79 parts of styrene, 79 parts of methacrylic acid, 105 parts of butyl acrylate, 13 parts of divinylbenzene, and 1 part of ammonium persulfate. The mixture is agitated for 15 minutes at a revolution of 400 rpm, thus preparing a white emulsion. The white emulsion is heated to 75° C. and subjected to reaction for 5 hours. A 1% aqueous solution of ammonium persulfate in an amount of 30 parts is further added to the emulsion, and the mixture is aged for 5 hours at 75° C. Thus, a resin particle dispersion that is an aqueous dispersion of a vinyl resin (i.e., a copolymer of styrene, methacrylic acid, butyl acrylate, and a sodium salt of a sulfate of ethylene oxide adduct of methacrylic acid) is prepared.

Resin particles in the resin particle dispersion have a volume average particle diameter of 105 nm when measured by a laser diffraction particle size distribution analyzer LA-920 (from Horiba, Ltd.). The dried resin particles partially separated from the resin particle dispersion have a glass transition temperature of 95° C., a number average molecular weight of 140,000, and a weight average molecular weight of 980,000.

Preparation of Aqueous Medium

An aqueous medium is prepared by mixing and agitating 306 parts of ion-exchange water, 60 parts of the resin particle dispersion, and 4 parts of sodium dodecylbenzenesulfonate.

Preparation of Emulsion Slurry

While agitating 200 parts of the aqueous medium in a vessel at a revolution of 10,500 rpm using a TK HOMOMIXER (from PRIMIX Corporation), 100 parts of each toner component liquid 1 are added and mixed for 2 minutes. Thereafter, the resulting emulsion is further agitated at a revolution of 4,500 rpm for a proper time period until the volume average particle diameter of oil droplets becomes 6.0 μm and the ratio of the volume average particle diameter to the number average particle diameter becomes 1.15±0.2. Thus, an emulsion slurry is prepared.

Removal of Organic Solvents

A flask equipped with a stirrer and a thermometer is charged with 100 parts of the emulsion slurry. The emulsion slurry is agitated for 12 hours at 30° C. at a peripheral speed of 20 m/min so that the organic solvents are removed therefrom. Thus, a dispersion slurry is prepared.

Washing and Drying

The dispersion slurry in an amount of 100 parts is filtered under reduced pressures, and mixed with 100 parts of ion-exchange water using a TK HOMOMIXER for 10 minutes at a revolution of 12,000 rpm, followed by filtering, thus obtaining a wet cake (i). The wet cake (i) is mixed with 300 parts of ion-exchange water using a TK HOMOMIXER for 10 minutes at a revolution of 12,000 rpm, followed by filtering. This operation is repeated twice, thus obtaining a wet cake (ii). The wet cake (ii) is mixed with 20 parts of a 10% aqueous solution of sodium hydroxide using a TK HOMOMIXER for 30 minutes at a revolution of 12,000 rpm, followed by filtering under reduced pressures, thus obtaining a wet cake (iii). The wet cake (iii) is mixed with 300 parts of ion-exchange water using a TK HOMOMIXER for 10 minutes at a revolution of 12,000 rpm, followed by filtering, thus obtaining a wet cake (iv). The wet cake (iv) is mixed with 300 parts of ion-exchange water using a TK HOMOMIXER for 10 minutes at a revolution of 12,000 rpm, followed by filtering. This operation is repeated twice, thus obtaining a wet cake (v). The wet cake (v) is mixed with 20 parts of a 10% hydrochloric acid using a TK HOMOMIXER for 10 minutes at a revolution of 12,000 rpm, followed by filtering, thus obtaining a wet cake (vi). The wet cake (vi) is mixed with 300 parts of ion-exchange water using a TK HOMOMIXER for 10 minutes at a revolution of 12,000 rpm, followed by filtering. This operation is repeated twice, thus obtaining a wet cake (vii). The wet cake (vii) is dried by a drier for 48 hours at 45° C., and filtered with a mesh having openings of 75 μm. Thus, a mother toner is prepared.

The mother toner in an amount of 100 parts is mixed with 1.5 parts of a hydrophobized silica (HDK H2000 from Wacker Chemie GmbH, having a particle diameter of 10 nm) and 1.0 parts of a hydrophobized titanium oxide (MT-150AI from TAYCA) by a HENSCHEL MIXER. Thus, a toner set 1 is prepared.

Example 2

Preparation of Toner Composition Liquids 2

A yellow toner composition liquid 2 is prepared by mixing 125 parts of the yellow mater batch liquid B, 20 parts of the yellow master batch liquid D, 25 parts of the wax dispersion, and 62 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid).

A magenta toner composition liquid 2 is prepared by mixing 125 parts of the magenta mater batch liquid B, 15 parts of the magenta master batch liquid D, 25 parts of the wax dispersion, and 58 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid).

A cyan toner composition liquid 2 is prepared by mixing 125 parts of the cyan mater batch liquid B, 25 parts of the wax dispersion, and 70 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid).

A black toner composition liquid 2 is prepared by mixing 125 parts of the black mater batch liquid B, 15 parts of the black master batch liquid D, 25 parts of the wax dispersion, and 58 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid).

Preparation of Emulsion Slurry

While agitating 200 parts of the aqueous medium in a vessel at a revolution of 10,500 rpm using a TK HOMOMIXER (from PRIMIX Corporation), 130 parts of each toner component liquid 2 are added and mixed for 2 minutes. Thereafter, the resulting emulsion is further agitated at a revolution of 4,500 rpm for a proper time period until the volume average particle diameter of oil droplets becomes 6.0 μm and the ratio of the volume average particle diameter to the number average particle diameter becomes 1.15±0.2. Thus, an emulsion slurry is prepared. The subsequent processes are the same as those for preparing the toner set 1. Thus, a toner set 2 is prepared.

Example 3

Preparation of Toner Composition Liquids 3

A yellow toner composition liquid 3 is prepared by mixing 75 parts of the yellow mater batch liquid A, 40 parts of the yellow master batch liquid D, 25 parts of the wax dispersion, 52 parts of the amorphous polyester A, and 12 parts of ethyl acetate.

A magenta toner composition liquid 3 is prepared by mixing 75 parts of the magenta mater batch liquid A, 50 parts of the magenta master batch liquid D, 25 parts of the wax dispersion, 48 parts of the amorphous polyester A, and 8 parts of ethyl acetate.

A cyan toner composition liquid 3 is prepared by mixing 75 parts of the cyan mater batch liquid A, 20 parts of the cyan master batch liquid D, 25 parts of the wax dispersion, 60 parts of the amorphous polyester A, and 20 parts of ethyl acetate.

A black toner composition liquid 3 is prepared by mixing 75 parts of the black mater batch liquid A, 50 parts of the cyan master batch liquid D, 25 parts of the wax dispersion, 48 parts of the amorphous polyester A, and 8 parts of ethyl acetate.

Preparation of Urea-Modified Polyester

A reaction vessel equipped with a condenser, a stirrer, and a nitrogen inlet pipe is charged with 682 pars of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The mixture is subjected to reaction for 8 hours at 230° C. under normal pressures. The mixture is further subjected to reaction for 5 hours under reduced pressures of 10 to 15 mmHg. Thus, an intermediate polyester is prepared. The intermediate polyester have a number average molecular weight of 2,100, a weight average molecular weight of 9,600, a glass transition temperature (Tg) of 55° C., an acid value of 0.5 mgKOH/g, and a hydroxyl value of 49 mgKOH/g.

Another reaction vessel equipped with a condenser, a stirrer, and a nitrogen inlet pipe is charged with 411 parts of the intermediate polyester, 89 parts of isophorone diisocyanate, and 500 parts of ethyl acetate. The mixture is subjected to reaction for 5 hours at 100° C. Thus, a urea-modified polyester (i.e., a precursor of an amorphous polyester) is prepared. The urea-modified polyester includes 1.60% of free isocyanates and 50% of solid components (after being left for 45 minutes at 150° C.).

Preparation of Ketimine (Compound having Active Hydrogen Group)

A reaction vessel equipped with a stirrer and a thermometer is charged with 30 parts of isophoronediamine and 70 parts of methyl ethyl ketone. The mixture is subjected to reaction for 5 hours at 50° C. Thus, a ketimine compound (i.e., a compound having an active hydrogen group) is prepared. The ketimine compound have an amine value of 423.

Preparation of Emulsion Slurry

A urea-modified toner composition liquid 3 is prepared by mixing 10 parts of the urea-modified polyester and 90 parts of each of the toner composition liquids 3. While agitating 200 parts of the aqueous medium in a vessel at a revolution of 10,500 rpm using a TK HOMOMIXER (from PRIMIX Corporation), 100 parts of each urea-modified toner component liquid 3 are added and mixed for 2 minutes. Thereafter, the resulting emulsion is further agitated at a revolution of 4,500 rpm for a proper time period until the volume average particle diameter of oil droplets becomes 6.0 μm and the ratio of the volume average particle diameter to the number average particle diameter becomes 1.15±0.2. Thus, an emulsion slurry is prepared. The subsequent processes are the same as those for preparing the toner set 1. Thus, a toner set 3 is prepared.

Comparative Example 1

Preparation of Toner Composition Liquids 4

A yellow toner composition liquid 4 is prepared by mixing 70 parts of the yellow mater batch liquid C, 25 parts of the wax dispersion, 48 parts of the crystalline polyester dispersion, 50 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid), and 21 parts of ethyl acetate.

A magenta toner composition liquid 4 is prepared by mixing 80 parts of the magenta mater batch liquid C, 25 parts of the wax dispersion, 48 parts of the crystalline polyester dispersion, 46 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid), and 17 parts of ethyl acetate.

A cyan toner composition liquid 4 is prepared by mixing 50 parts of the cyan mater batch liquid C, 25 parts of the wax dispersion, 48 parts of the crystalline polyester dispersion, 58 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid), and 29 parts of ethyl acetate.

A black toner composition liquid 4 is prepared by mixing 80 parts of the black mater batch liquid C, 25 parts of the wax dispersion, 48 parts of the crystalline polyester dispersion, 46 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid), and 17 parts of ethyl acetate. The subsequent processes are the same as those for preparing the toner set 1. Thus, a toner set 4 is prepared.

Comparative Example 2

Preparation of Toner Composition Liquids 5

A yellow toner composition liquid 5 is prepared by mixing 70 parts of the yellow mater batch liquid D, 25 parts of the wax dispersion, 60 parts of the crystalline polyester dispersion, and 42 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid).

A magenta toner composition liquid 5 is prepared by mixing 80 parts of the magenta mater batch liquid D, 25 parts of the wax dispersion, 60 parts of the crystalline polyester dispersion, and 38 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid).

A cyan toner composition liquid 5 is prepared by mixing 50 parts of the cyan mater batch liquid D, 25 parts of the wax dispersion, 60 parts of the crystalline polyester dispersion, and 50 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid).

A black toner composition liquid 5 is prepared by mixing 80 parts of the black mater batch liquid D, 25 parts of the wax dispersion, 60 parts of the crystalline polyester dispersion, and 38 parts of the amorphous polyester B (having a glass transition temperature of 63° C. and a weight average molecular weight of 30,000, composed of ethylene oxide adduct and propylene oxide adduct of bisphenol A, terephthalic acid, and isophthalic acid). The subsequent processes are the same as those for preparing the toner set 1. Thus, a toner set 5 is prepared.

Comparative Example 3

Preparation of Toner Composition Liquids 6

A yellow toner composition liquid 6 is prepared by mixing 70 parts of the yellow mater batch liquid D, 25 parts of the wax dispersion, 48 parts of the crystalline polyester dispersion, 40 parts of the amorphous polyester A, and 21 parts of ethyl acetate.

A magenta toner composition liquid 6 is prepared by mixing 80 parts of the magenta mater batch liquid D, 25 parts of the wax dispersion, 48 parts of the crystalline polyester dispersion, 36 parts of the amorphous polyester A, and 17 parts of ethyl acetate.

A cyan toner composition liquid 6 is prepared by mixing 50 parts of the cyan mater batch liquid D, 25 parts of the wax dispersion, 48 parts of the crystalline polyester dispersion, 48 parts of the amorphous polyester A, and 29 parts of ethyl acetate.

A black toner composition liquid 6 is prepared by mixing 80 parts of the black mater batch liquid D, 25 parts of the wax dispersion, 48 parts of the crystalline polyester dispersion, 36 parts of the amorphous polyester A, and 17 parts of ethyl acetate. The subsequent processes are the same as those for preparing the toner set 1. Thus, a toner set 6 is prepared.

The compositions of the above-prepared toner sets are shown in Table 1.

TABLE 1

| | | Toner Composition (parts) | | | | | | Colorant Content (%) | |
|---|---|---|---|---|---|---|---|---|---|
| | | Colorant | | | | | | | |
| | Toner | In C-PES* | in A-PES** | C-PES* | A-PES** | Wax | Prepolymer | In C-PES* | In A-PES** |
| Example 1 | Yellow | 3 | 4 | 12 | 83 | 5 | 0 | 20 | 4.6 |
| | Magenta | 3 | 5 | 12 | 83 | 5 | 0 | 20 | 5.7 |
| | Cyan | 3 | 2 | 12 | 83 | 5 | 0 | 20 | 2.4 |
| | Black | 3 | 5 | 12 | 83 | 5 | 0 | 20 | 5.7 |
| Example 2 | Yellow | 5 | 2 | 20 | 75 | 5 | 0 | 20 | 2.6 |
| | Magenta | 5 | 3 | 20 | 75 | 5 | 0 | 20 | 3.8 |
| | Cyan | 5 | 0 | 20 | 75 | 5 | 0 | 20 | 0.0 |
| | Black | 5 | 3 | 20 | 75 | 5 | 0 | 20 | 3.8 |
| Example 3 | Yellow | 3 | 4 | 12 | 73 | 5 | 10 | 20 | 5.2 |
| | Magenta | 3 | 5 | 12 | 73 | 5 | 10 | 20 | 6.4 |
| | Cyan | 3 | 2 | 12 | 73 | 5 | 10 | 20 | 2.7 |
| | Black | 3 | 5 | 12 | 73 | 5 | 10 | 20 | 6.4 |
| Comparative Example 1 | Yellow | 0 | 7 | 12 | 83 | 5 | 0 | 0 | 7.8 |
| | Magenta | 0 | 8 | 12 | 83 | 5 | 0 | 0 | 8.8 |
| | Cyan | 0 | 5 | 12 | 83 | 5 | 0 | 0 | 5.7 |
| | Black | 0 | 8 | 12 | 83 | 5 | 0 | 0 | 8.8 |
| Comparative Example 2 | Yellow | 0 | 7 | 20 | 75 | 5 | 0 | 0 | 8.5 |
| | Magenta | 0 | 8 | 20 | 75 | 5 | 0 | 0 | 9.6 |
| | Cyan | 0 | 5 | 20 | 75 | 5 | 0 | 0 | 6.3 |
| | Black | 0 | 8 | 20 | 75 | 5 | 0 | 0 | 9.6 |
| Comparative Example 3 | Yellow | 0 | 7 | 12 | 73 | 5 | 10 | 0 | 8.8 |
| | Magenta | 0 | 8 | 12 | 73 | 5 | 10 | 0 | 9.9 |
| | Cyan | 0 | 5 | 12 | 73 | 5 | 10 | 0 | 6.4 |
| | Black | 0 | 8 | 12 | 73 | 5 | 10 | 0 | 9.9 |

*C-PES: Crystalline Polyester
**A-PES: Amorphous Polyester

To evaluate dispersion conditions of colorants and crystalline polyester in the toners, each mother toner is embedded in an epoxy resin and cut into ultra thin section. The ultra thin section is observed by a transmission electron microscope (TEM). It is observed in Examples 1 to 3 that colorant particles previously dispersed in the crystalline polyester master batch keep being dispersed in the crystalline polyester domains in the toners. The crystalline polyester domain size is almost the same as the dispersion diameter in the crystalline polyester dispersion.

Evaluation of Heat-Resistant Storage Stability

Each toner is stored at 50° C. for 8 hours, and thereafter sieved with a 42 mesh for 2 minutes and the residual rate of toner particles remaining on the mesh is measured. The smaller the residual rate, the better the heat-resistant storage stability. Heat-resistant storage stability is graded by the residual rate as follows.

A: less than 10%

B: not less than 10% and less than 20%

C: not less than 20% and less than 30%

D: not less than 30%

Preparation of Carrier

A carrier is prepared by covering spherical ferrite particles having a volume average particle diameter of 35 μm with a mixture of a silicone resin and a melamine resin.

Preparation of Developers

Each toner in an amount of 10 parts and the carrier in an amount of 90 parts are mixed with a TURBULA MIXER. Thus, two-component developer sets 1 to 6 are prepared.

The two-component developers are subjected to the following evaluations using a tandem full-color image forming apparatus (IMAGIO NEO C350 from Ricoh Co., Ltd.) which has-been modified such that the silicone oil applicator is removed from its fixing unit and the temperature and linear speed is made variable.

Evaluation of Fixable Temperature Range

Solid toner images having 0.6 mg/cm$^2$ of toner are formed on a paper TYPE 6200 (from Ricoh Co., Ltd.). To determine the minimum fixable temperature below which cold offset occurs and the maximum fixable temperature above which hot offset occurs, solid toner images are passed through the fixing unit while varying the fixing temperature from 110° C. to every 10 degrees above, and setting the paper feed linear speed to 150 mm/sec, the surface pressure to 2.0 kgf/cm$^2$, and the nip width to 3 mm.

Evaluation of Image Density, Chroma, and Gloss

A solid image having 0.35 mg/cm$^2$ of toner is formed on a POD gloss paper from Oji Paper Co., Ltd., and passed through the fixing unit while setting the paper feed linear speed to 150 mm/sec, the surface pressure to 2.0 kgf/cm$^2$, the nip width to 3 mm, and the fixing temperature to 150° C. The solid image thus fixed on the gloss paper is subjected to a measurement with X-RITE 938 to determine a reflected image density (ID) and chroma (*c). The fixed solid image is further subjected to a measurement of 60°-gloss with a gloss meter VG-7000 (from Nippon Denshoku Industries Co., Ltd.). Image gloss level is graded as follows.

A: not less than 50%

B: not less than 30% and less than 50%

C: not less than 20% and less than 30%

D: less than 20%

The evaluation results are shown in Table 2.

TABLE 2

| | Toner | Minimum Fixable Temperature (° C.) | Maximum Fixable Temperature (° C.) | Image Density | Chroma | Gloss | Heat-resistant Storage Stability |
|---|---|---|---|---|---|---|---|
| Example 1 | Yellow | 115 | 180 | 2.08 | 104.9 | A | A |
| | Magenta | 115 | 180 | 2.05 | 78.2 | A | A |
| | Cyan | 115 | 180 | 1.72 | 64.2 | A | A |
| | Black | 115 | 180 | 2.01 | — | A | A |
| Example 2 | Yellow | 120 | 180 | 2.02 | 104.2 | A | A |
| | Magenta | 120 | 180 | 20.3 | 77.6 | A | A |
| | Cyan | 120 | 180 | 1.69 | 63.7 | A | A |
| | Black | 120 | 180 | 2.00 | — | A | A |
| Example 3 | Yellow | 115 | 200 | 2.02 | 104.4 | A | A |
| | Magenta | 115 | 200 | 2.00 | 77.6 | A | A |
| | Cyan | 115 | 200 | 1.71 | 63.8 | A | A |
| | Black | 115 | 200 | 2.01 | — | A | A |
| Comparative | Yellow | 115 | 180 | 1.78 | 102.2 | C | C |
| Example 1 | Magenta | 120 | 180 | 1.67 | 73.2 | D | B |
| | Cyan | 115 | 180 | 1.58 | 62.2 | B | C |
| | Black | 120 | 180 | 1.72 | — | D | B |
| Comparative | Yellow | 120 | 180 | 1.69 | 100.3 | D | C |
| Example 2 | Magenta | 130 | 180 | 1.62 | 71.6 | D | B |
| | Cyan | 125 | 180 | 1.42 | 61.9 | D | D |
| | Black | 130 | 180 | 1.62 | — | D | B |
| Comparative | Yellow | 120 | 200 | 1.75 | 101.6 | C | C |
| Example 3 | Magenta | 125 | 200 | 1.62 | 72.2 | D | B |
| | Cyan | 115 | 200 | 1.48 | 61.9 | B | C |
| | Black | 125 | 200 | 1.68 | — | D | B |

Exemplary toners express high gloss, high coloring power, and high chroma while keeping low-temperature fixability similar to or better than that of comparative toners. Exemplary toners also have good heat-resistant storage stability.

Additional modifications and variations of the present invention are possible in light of the above teachings. It is therefore to be understood that within the scope of the appended claims the invention may be practiced other than as specifically described herein.

What is claimed is:

1. A toner, comprising:

an amorphous polyester;

a crystalline polyester forming domains in the toner; and a colorant being dispersed in at least the domains of the crystalline polyester, wherein the colorant is dispersed in the amorphous polyester in a colorant content (A) of from 2.4 to 7% by weight, based on a total weight of the amorphous polyester, and the colorant content (C) in the crystalline polyester domains based on a total weight of the crystalline polyester and the colorant dispersed therein is greater than the colorant content (A) in the amorphous polyester.

2. The toner according to claim 1, the toner being obtained by a method comprising:

dispersing an oil phase in an aqueous medium to prepare an oil-in-water (O/W) dispersion, the oil phase including the amorphous polyester or a precursor capable of producing the amorphous polyester, the crystalline polyester, the colorant, and an organic solvent; and removing the organic solvent from the 0/W dispersion.

3. The toner according to claim 1, the crystalline polyester having an endothermic peak of 60 to 110° C. measured by differential scanning calorimetry.

4. A toner set, comprising:

a yellow toner comprising a colorant C. I. Pigment Yellow 185;

a magenta toner comprising a mixed colorant of C. I. Pigment Red 122 and C. I. Pigment Red 269;

a cyan toner comprising a colorant C. I. Pigment Blue 15:3; and a black toner comprising a carbon black, the yellow, magenta, cyan, and black toners each comprising an amorphous polyester and a crystalline polyester forming domains in the toner, and each colorant being dispersed in the domains of the crystalline polyester in each toner, wherein in each toner the colorant is dispersed in the amorphous polyester in a colorant content (A) of from 2.4 to 7% by weight, based on a total weight of the amorphous polyester, and the colorant content (C) in the crystalline polyester domains based on a total weight of the crystalline polyester and the colorant dispersed therein is greater than the colorant content (A) in the amorphous polyester.

5. A developer, comprising the toner according to claim 1 and a carrier.

6. A developer set, comprising:

a yellow developer comprising a carrier and a yellow toner comprising a colorant C. I. Pigment Yellow 185;

a magenta developer comprising a carrier and a magenta toner comprising a mixed colorant of C. I. Pigment Red 122 and C. I. Pigment Red 269;

a cyan developer comprising a carrier and a cyan toner comprising a colorant C. I. Pigment Blue 15:3; and a black developer comprising a carrier and a black toner comprising a carbon black, the yellow, magenta, cyan, and black toners each comprising an amorphous polyester and a crystalline polyester forming domains in the toner, and each colorant being dispersed in the domains of the crystalline polyester in each toner, wherein in each toner the colorant is dispersed in the amorphous polyester in a colorant content (A) of from 2.4 to 7% by weight, based on a total weight of the amorphous polyester, and the colorant content (C) in the crystalline polyester domains based on a total weight of the crystalline polyester and the colorant dispersed therein is greater than the colorant content (A) in the amorphous polyester.

7. An image forming method, comprising:

charging a surface of an image bearing member;

developing an electrostatic latent image formed on the image bearing member into a toner image with the toner according to claim 1, the toner image having 0.4 mg/cm2 of the toner;

transferring the toner image from the image bearing member onto a recording medium; and fixing the toner image on the recording medium.

* * * * *